US010226125B2

(12) United States Patent
Park et al.

(10) Patent No.: US 10,226,125 B2
(45) Date of Patent: Mar. 12, 2019

(54) EFFECT CONTROL SYSTEM OF SCREENING FACILITY CHAIR AND METHOD THEREOF

(71) Applicant: CJ 4DPLEX CO., LTD., Seoul (KR)

(72) Inventors: Hyun Park, Seongnam-si (KR); Myung Chul Kim, Seoul (KR); Chang Woo Nam, Busan (KR)

(73) Assignee: CJ 4DPLEX CO., LTD., Seoul (KR)

( * ) Notice: Subject to any disclaimer, the term of this patent is extended or adjusted under 35 U.S.C. 154(b) by 0 days.

(21) Appl. No.: 15/516,201

(22) PCT Filed: Sep. 24, 2015

(86) PCT No.: PCT/KR2015/010078
§ 371 (c)(1),
(2) Date: Mar. 31, 2017

(87) PCT Pub. No.: WO2016/052923
PCT Pub. Date: Apr. 7, 2016

(65) Prior Publication Data

US 2017/0290430 A1 Oct. 12, 2017

(30) Foreign Application Priority Data

Oct. 2, 2014 (KR) ..... 10-2014-0133273

(51) Int. Cl.
*A63G 31/16* (2006.01)
*A47C 1/12* (2006.01)
(Continued)

(52) U.S. Cl.
CPC ..... *A47C 1/12* (2013.01); *A47C 1/02* (2013.01); *A47C 7/748* (2013.01); *A63J 5/00* (2013.01);
(Continued)

(58) Field of Classification Search
CPC ..... A63G 31/00; A63G 31/02; A63G 31/04; A63G 31/10; A63G 31/14; A63G 31/16;
(Continued)

(56) References Cited

U.S. PATENT DOCUMENTS 6,224,491 B1 * 5/2001 Hiromi ..... A63G 31/007 297/180.1
6,796,908 B2 * 9/2004 Weston ..... A63G 7/00 434/55
8,241,133 B1 * 8/2012 Lewis ..... A63G 31/16 104/53

FOREIGN PATENT DOCUMENTS

CN 103251243 A 8/2013
JP 2004-135789 A 5/2004
(Continued)

OTHER PUBLICATIONS

International Search Report for PCT/KR2015/010078 dated Nov. 23, 2015.
Japanese Office Action dated Mar. 20, 2018, issued in corresponding Japanese Patent Application No. 2017-517717.
(Continued)

*Primary Examiner* — Kien Nguyen
(74) *Attorney, Agent, or Firm* — Hauptman Ham, LLP

(57) ABSTRACT

The present invention relates to an effect control system of a screening facility chair and a method thereof, and the effect control system includes an input device for transmitting chair angle control information or effect control information input from a user to a management server; the management server for transmitting the chair angle control information or the effect control information to a corresponding motion chair; and the motion chair for adjusting a slope according to the chair angle control information or providing an effect synchronized with an image according to the effect control information.

18 Claims, 7 Drawing Sheets

(51) Int. Cl.

| | |
|---|---|
| ***A63J 25/00*** | (2009.01) |
| ***A47C 1/02*** | (2006.01) |
| ***A47C 7/74*** | (2006.01) |
| ***A63J 5/00*** | (2006.01) |

(52) U.S. Cl.
CPC ..... *A63J 25/00* (2013.01); *A63J 2005/002* (2013.01); *A63J 2005/003* (2013.01); *A63J 2005/006* (2013.01); *A63J 2005/008* (2013.01)

(58) Field of Classification Search
CPC ..... A63G 31/22; A63G 31/24; A47C 1/00; A47C 1/12; H04N 5/00; H04N 5/222
USPC ..... 472/39, 47, 59–61, 130; 297/313, 297/325–327; 52/6, 9
See application file for complete search history.

(56) References Cited

FOREIGN PATENT DOCUMENTS

| | | | |
|---|---|---|---|
| KR | 10-2002-0071305 | A | 9/2002 |
| KR | 10-2011-0139613 | A | 12/2011 |
| KR | 10-2011-0139614 | | 12/2011 |
| KR | 10-1154143 | B1 | 6/2012 |
| KR | 10-1220632 | B1 | 1/2013 |
| TW | 201204290 | A1 | 2/2012 |
| WO | 2013/125775 | A1 | 8/2013 |

OTHER PUBLICATIONS

Chinese Office Action dated Aug. 29, 2018 for corresponding Chinese Application No. 201580053505.7.

* cited by examiner

EFFECT CONTROL SYSTEM OF SCREENING FACILITY CHAIR AND METHOD THEREOF

CROSS REFERENCE TO RELATED APPLICATION

This present application is a national stage filing under 35 U.S.C. § 371 of PCT application number PCT/KR2015/010078 filed on Sep. 24, 2015 which is based upon and claims the benefit of priority to Korean Patent Application Nos. 10-2014-0133273 filed on Oct. 2, 2014 in the Korean Intellectual Property Office. The disclosures of the above-listed applications are hereby incorporated by reference herein in their entirety.

TECHNICAL FIELD

The present invention relates to an effect control system of a screening facility chair and a method thereof, and more specifically, to an effect control system of a screening facility chair and a method thereof, which set and provide 4D effects using an input device installed in a motion chair or a user terminal carried by a user.

BACKGROUND ART

In the past, only a video image is played for audience in a video image screening facility such as a theater or a movie house. However, in addition to the video image, diverse effects are provided to the audience recently.

If it is said that a theater which plays a general video image is a 2D theater and a theater which plays a video image specially manufactured for audience to feel a stereoscopic perception while watching the video image is a 3D theater, a theater in which the audience may watch a video image while feeling five senses by stimulating senses of touch, smell and the like, as well as sight and hearing, is a 4D theater.

In the 4D theater, a motion base for moving a chair occupied by a viewer is installed under the chair, and a special effect device for providing the audience with diverse effects are installed in the chair, the inner walls and the ceiling of the theater.

When the audience watch a movie, they do not simply see only an image, but their interest and immersion in the movie can be increased by realistically feeling a motion synchronized with the image and the effects of water, wind, smoke, heat and the like by themselves.

A plurality of chair sets is arranged in a currently operating 4D theater, and the chair set includes, in addition to the motion base, a 4D effect apparatus installed on the backside of a chair set placed in the front row to inject water, wind, scent or the like. The 4D effect apparatus injects a material for generating a 4D effect from the backside of the chair set placed in the front row to the viewer sitting in a chair set placed in the back row.

Such a 4D effect apparatus is controlled by a central device which controls the entire theater and provides the same 4D effects to all the audience.

However, there are cases in which some of the audience dislike the 4D effects injected onto their faces. If the 4D effects are provided to all the audience, the 4D effects may induce displeasure to some of the audience while a movie is played. In addition, although some of the audience like the 4D effects, immersion in the movie felt by the audience may be lowered if 4D effects further stronger than their likings are provided.

In addition, a chair installed in a conventional screening facility to provide the 4D effects has a problem in that a viewer sitting in the back row cannot select intensity or a type of the 4D effects injected from a chair in the front row. Since the audience cannot select a type or intensity of the 4D effects desired by themselves, all the audience are provided with 4D effects of the same type and intensity.

DISCLOSURE OF INVENTION

Technical Problem

Therefore, the present invention has been made in view of the above problems, and it is an object of the present invention to provide an effect control system of a screening facility chair and a method thereof, in which a viewer entering a video image screening facility may individually set 4D effects desired by himself or herself and can be provided with the set 4D effects.

Another object of the present invention is to provide an effect control system of a screening facility chair and a method thereof, in which a user may set 4D effects using an input device installed in a specific area of a motion chair or a user terminal carried by the user.

Still another object of the present invention is to provide an effect control system of a screening facility chair and a method thereof, in which the best 4D effects can be provided to a user by setting a nozzle angle of an injector of a second motion chair placed in the front row according to the slope of a first motion chair occupied by a viewer.

Solution to Problem

To accomplish the above objects, according to one aspect of the present invention, there is provided an effect control system of a screening facility chair, the system including: an input device for transmitting chair angle control information or effect control information input from a user to a management server; the management server for transmitting the chair angle control information or the effect control information to a corresponding motion chair; and the motion chair for adjusting a slope according to the chair angle control information or providing an effect synchronized with an image according to the effect control information.

The management server may analyze and classify the effect control information into first effect control information and second effect control information, and transmit the chair angle control information or the first effect control information to a first motion chair corresponding to the input device or transmit the chair angle control information or the second effect control information to a second motion chair placed in a front row of the first motion chair.

The first motion chair may adjust the slope according to the chair angle control information or provide a first effect synchronized with the image according to the first effect control information.

If the slope is adjusted, the first motion chair may adjust a nozzle angle of an injector arranged on a backside of the first motion chair according to the slope of the first motion chair.

The second motion chair may adjust a nozzle angle of an injector according to the slope of the first motion chair and provide a user sitting in the first motion chair with a second effect synchronized with the image according to the second effect control information through the injector of the adjusted nozzle angle.

The first effect control information may include at least one of a tickler, a vibration effect, leg air and side air (L/R), and the second effect control information may include at least one of an air shot, a water shot, a scent shot and a heater shot.

The input device may be any one of an input device installed in a specific area of the motion chair, a separate near field communication terminal and a user terminal.

According to another aspect of the present invention, there is provided an effect control system of a screening facility chair, the system including: an input device for transmitting chair angle control information or effect control information input from a user to a corresponding motion chair; and the motion chair for adjusting a slope according to the chair angle control information or providing an effect synchronized with an image according to the effect control information.

The input device and the motion chair may be connected through near field communication.

The input device may analyze and classify the effect control information into first effect control information and second effect control information, and transmit the chair angle control information or the first effect control information to a first motion chair corresponding to the input device or transmit the chair angle control information or the second effect control information to a second motion chair placed in a front row of the first motion chair.

The first motion chair may adjust the slope according to the chair angle control information or provide a first effect synchronized with the image according to the first effect control information.

If the slope is adjusted, the first motion chair may adjust a nozzle angle of an injector arranged on a backside of the first motion chair according to the slope of the first motion chair.

The second motion chair may adjust a nozzle angle of an injector according to the slope of the first motion chair and provide a user sitting in the first motion chair with a second effect synchronized with the image according to the second effect control information through the injector of the adjusted nozzle angle.

The first effect control information may include at least one of a tickler, a vibration effect, leg air and side air (L/R), and the second effect control information may include at least one of an air shot, a water shot, a scent shot and a heater shot.

The input device may be any one of an input device installed in a specific area of the motion chair, a separate near field communication terminal and a user terminal.

According to still another aspect of the present invention, there is provided an effect control method of a screening facility chair, the method including the steps of: transmitting chair angle control information or effect control information input from a user to a management server, by an input device; transmitting the chair angle control information or the effect control information to a corresponding motion chair, by the management server; and adjusting a slope according to the chair angle control information or providing an effect synchronized with an image according to the effect control information, by the motion chair.

The step of transmitting chair angle control information or effect control information input from a user to a management server by the input device may include the steps of: recognizing, if a previously stored 4D effect application is executed, a motion chair occupied by the user; and transmitting, if chair angle control information or effect control information is input through the 4D effect application, the chair angle control information or the effect control information the management server.

The step of transmitting the chair angle control information or the effect control information to a corresponding motion chair by the management server may include the steps of: analyzing and classifying the effect control information into first effect control information and second effect control information; and transmitting the chair angle control information or the first effect control information to a first motion chair corresponding to the input device or transmitting the chair angle control information or the second effect control information to a second motion chair placed in a front row of the first motion chair.

The step of adjusting a slope according to the chair angle control information or providing an effect synchronized with an image according to the effect control information by the motion chair may include the step of adjusting, when the chair angle control information or first effect control information is received from the management server, the slope according to the chair angle control information or providing a first effect synchronized with the image according to the first effect control information, and adjusting, when the chair angle control information or second effect control information is received from the management server, a nozzle angle of an injector according to the chair angle control information and providing a second effect synchronized with the image according to the second effect control information through the injector of the adjusted nozzle angle.

According to still another aspect of the present invention, there is provided an effect control method of a screening facility chair, the method including the steps of: transmitting chair angle control information or effect control information input from a user to a corresponding motion chair, by an input device; and adjusting a slope according to the chair angle control information or providing an effect synchronized with an image according to the effect control information, by the motion chair.

The step of transmitting chair angle control information or effect control information input from a user to a corresponding motion chair by an input device may include the steps of: receiving the chair angle control information or the effect control information from the user; analyzing and classifying the effect control information into first effect control information and second effect control information; and transmitting the chair angle control information or the first effect control information to a first motion chair corresponding to the input device or transmitting the chair angle control information or the second effect control information to a second motion chair placed in a front row of the first motion chair.

The step of adjusting a slope according to the chair angle control information or providing an effect synchronized with an image according to the effect control information by the motion chair may include the step of adjusting, when the chair angle control information or first effect control information is received from the input device, the slope according to the chair angle control information or providing a first effect synchronized with the image according to the first effect control information, and adjusting, when the chair angle control information or second effect control information is received from the input device, a nozzle angle of an injector according to the chair angle control information and providing a second effect synchronized with the image according to the second effect control information through the injector of the adjusted nozzle angle.

Advantageous Effects of Invention

According to the present invention, a viewer entering a video image screening facility may be provided with only the 4D effects desired by himself or herself by individually setting the 4D effects desired by himself or herself and thus comfortably enjoy a video image.

In addition, since the 4D effects can be set using an input device installed in a specific area of a motion chair or a user terminal carried by a user, the 4D effects can be set although the input device installed in the motion chair is out of order.

In addition, the best 4D effects can be provided to a user by adjusting a nozzle angle of an injector of a second motion chair placed in the front row according to the slope of a first motion chair occupied by a viewer.

MODE FOR INVENTION

Figure 1:
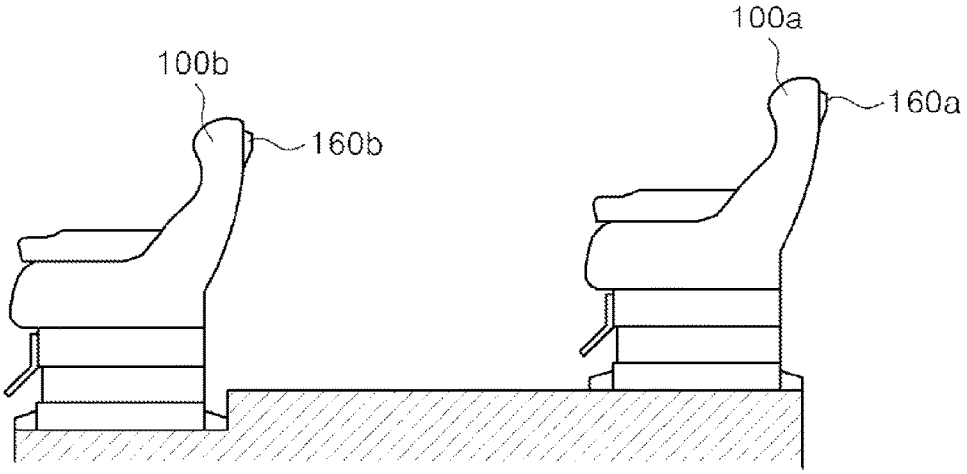
FIG. 1 is a view showing arrangement of chairs in a video image screening facility according to an embodiment of the present invention.

Hereafter, an effect control system of a screening facility chair and a method thereof will be described in detail with reference to the accompanying drawings. The disclosed embodiments are provided to enable those skilled in the art to easily understand the scope of the present invention, and the present invention is not limited by such embodiments. Moreover, matters illustrated in the drawings are schematized in order to describe or explain the embodiments of the present invention more easily, and hence, may be different from forms embodied actually.

Meanwhile, the constitutional components expressed below are merely examples for implementing the present invention. Accordingly, other components may be used in other implementations of the present invention without departing from the spirit and scope of the present invention. In addition, although each component can be implemented only in a pure hardware or software configuration, it also can be implemented by combining various hardware or software configurations performing the same function. In addition, two or more components may be implemented together by one piece of hardware or software.

In addition, the expression of 'including' an element is an expression of an 'open type' which merely refers to existence of a corresponding component, and it should not be construed as precluding additional components.

FIG. 1 is a view showing arrangement of chairs in a video image screening facility according to an embodiment of the present invention.

Referring to FIG. 1, in a video image screening facility, a chair in a back row (hereinafter, referred to as a 'first motion chair') 100*a* and a chair in a front row (hereinafter, referred to as a 'second motion chair') 100*b* are installed on the floor of the video image screening facility in the form of steps. The present invention is applicable in a screening facility in which the first motion chair 100*a* and the second motion chair 100*b* are arranged to be spaced apart from each other by a predetermined distance.

The first motion chair 100*a* and the second motion chair 100*b* respectively include an input device (not shown) capable of adjusting 4D effects by a user and an injector 160*a* and 160*b* installed on the backside of the motion chair to provide a user sitting in a motion chair of the back row with a second effect such as an air shot, a water shot, a scent shot, a heater shot or the like.

If a user sitting in the first motion chair 100*a* inputs chair angle control information and effect control information, the first motion chair 100*a* adjusts the slope of the backrest according to the chair angle control information and provides the user with a first effect such as a tickler, a vibration effect, leg air, side air (L/R) or the like, and the second motion chair 100*b* placed in the front row of the first motion chair 100*a* provides the user sitting in the first motion chair 100*a* with a second effect such as an air shot, a water shot, a scent shot, a heater shot or the like.

Figure 2:
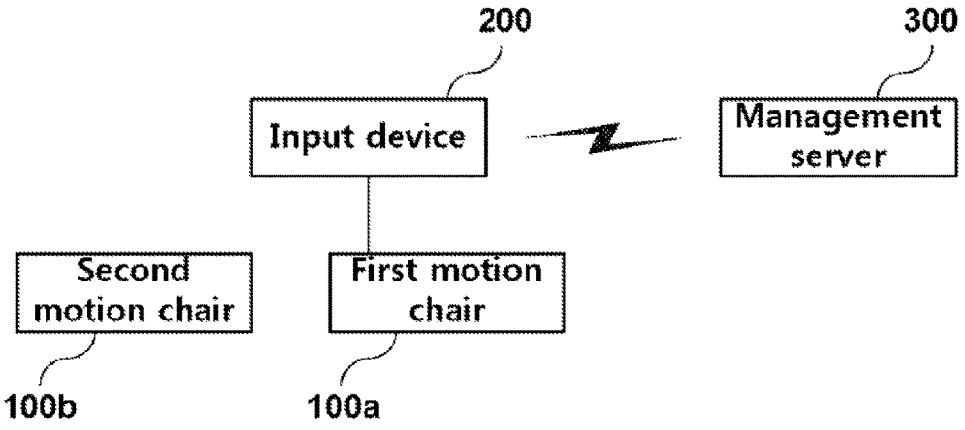
FIG. 2 is a view showing an effect control system of a screening facility chair according to an embodiment of the present invention.

FIG. 2 is a view showing an effect control system of a screening facility chair according to an embodiment of the present invention.

Referring to FIG. 2, an effect control system of a screening facility chair includes a chair in a back row occupied by a user (hereinafter, referred to as a 'first motion chair') 100*a*, a chair in the front row of the first motion chair 100*a* (hereinafter, referred to as a 'second motion chair') 100*b*, an input device 200 and a management server 300.

The input device 200 receives chair angle control information or effect control information from the user and transmits the input chair angle control information or effect control information to the management server 300. Here, the effect control information includes first effect control information including a tickler, a vibration effect, leg air, side air (L/R) and the like and second effect control information including an air shot, a water shot, a scent shot, a heater shot and the like. The first effect control information may be effect control information provided by the first motion chair 100*a* occupied by the user, and the second effect control information may be effect control information provided to the user sitting in the first motion chair 100*a* by the injector arranged on the backside of the second motion chair 100*b* placed in the front row of the first motion chair 100*a* occupied by the user. The tickler provides an effect of tapping or touching a leg, the back or a buttock of a viewer, and the air shot is shooting pressured air to the face, the neck or the back head, and the water shot is sprinkling water to the viewer in a spraying method so that the viewer may feel diverse special effects while watching the movie. In addition, the scent effect provides the viewer with a scent shot, and the heater provides a thermal effect to the viewer.

The input device 200 may be any one of an input device installed in a specific area of the motion chair 100, a separate near field communication terminal and a user terminal.

The input device 200 may be a remote controller, a button, a joystick, a touch pad or the like.

The input device 200 may be installed at a specific position of the motion chair 100, and the specific position may be the armrest of each motion chair 100 or the backside of the backrest of a motion chair in the front row. If the input device 200 is installed on the backside of the backrest of the motion chair, the person sitting in the motion chair in the back row should use the input device 200 installed on the backside of the backrest of the motion chair in the front row.

In addition, the input device 200 is a terminal independent from the motion chair 100 and may be a near field communication terminal provided by the theater or a portable mobile communication terminal possessed by the user.

If the input device 200 is a near field communication terminal provided by the theater, it should be provided to the user before the movie begins. Here, the near field communication terminal means a terminal implemented to transmit data through a near field communication network, such as infrared, Bluetooth, ZigBee, ultra wideband (UWB), WiFi or the like.

In addition, if the input device 200 is a portable mobile communication terminal possessed by the user, the input device 200 should be able to transmit the chair angle control information or the effect control information input from the user terminal to the management server 300, and the management server 300 should be able to recognize the chair angle control information or the effect control information transmitted from the user terminal. To this end, a 4D effect application or the like should be installed in the user terminal in advance. Here, the 4D effect application may be an application for recognizing the motion chair 100 occupied by the user and transmitting, when the chair angle control information or the effect control information is input from the user, the input chair angle control information or effect control information to the management server 300, together with information on the recognized motion chair.

As described above, a user may set 4D effects using the input device installed in a specific area of the motion chair 100, the near field communication terminal provided by the theater, the user terminal carried by the user or the like.

The management server 300 stores information on each of the motion chairs and transmits the chair angle control information or the effect control information transmitted from the input device 200. That is, the management server 300 analyzes and classifies the effect control information into first effect control information or second effect control information and transmits the chair angle control information or the first effect control information to the first motion chair 100*a* corresponding to the input device 200 or transmits the chair angle control information or the second effect control information to the second motion chair 100*b* placed in the front row of the first motion chair 100*a*.

The management server 300 stores information on the identification of each motion chair 100, information on the input device 200 installed in the motion chair 100, and information on the identification of a motion chair placed in the front row of each motion chair. Accordingly, if the chair angle control information or the effect control information is received from the input device 200, the management server 300 identifies the first motion chair 100*a* corresponding to the input device 200. Then, the management server 300 confirms the second motion chair 100*b* placed in the front row of the first motion chair 100*a* and analyzes and classifies the effect control information into the first effect control information including a tickler, a vibration effect, leg air, side air (L/R) and the like and the second effect control information including an air shot, a water shot, a scent shot, a heater shot and the like. Then, the management server 300 transmits the chair angle control information or the first effect control information to the first motion chair 100*a* and transmits the chair angle control information or the second effect control information to the second motion chair 100*b*.

If the chair angle control information or the first effect control information is received from the management server 300, the first motion chair 100*a* adjusts the slope of the backrest according to the chair angle control information or provides a first effect synchronized with an image according to the first effect control information. At this point, the first motion chair 100*a* provides the user sitting in the first motion chair 100*a* with a first effect such as a tickler, a vibration effect, leg air, side air (L/R) or the like according to the first effect control information. In addition, if the slope of the backrest of the first motion chair 100*a* is adjusted, the position of the injector arranged on the backside of the first motion chair 100*a* is changed according to the slope of the first motion chair 100*a*, and thus in order to provide the user sitting in the back row of the first motion chair 100*a* with a second effect such as an air shot, a water shot, a scent shot, a heater shot or the like, the nozzle angle of the injector arranged on the backside of the first motion chair 100*a* should be adjusted according to the slope of the backrest of the first motion chair.

If the chair angle control information or the second effect control information is received from the management server 300, the second motion chair 100*b* adjusts the nozzle angle of the injector according to the slope of the first motion chair 100*a* and provides the user sitting in the first motion chair 100*a* with a second effect synchronized with an image according to the second effect control information through the injector of the adjusted nozzle angle. That is, if the nozzle angle of the injector arranged on the backside of the second motion chair 100*b* is not adjusted although the slope of the first motion chair 100*a* is adjusted, the user sitting in the back row of the second motion chair 100*b* does not properly receive the second effect such as an air shot, a water shot, a scent shot, a heater shot or the like, and thus the second motion chair 100*b* should adjust the nozzle angle of the injector according to the slope of the backrest of the first motion chair 100*a*. Then, the second motion chair 100*b* provides the user sitting in the first motion chair 100*a* with a second effect such as an air shot, a water shot, a scent shot, a heater shot or the like according to the second effect control information.

As described above, the first motion chair 100*a* occupied by a user adjusts the slope according to the chair angle control information if the chair angle control information is received from the management server 300 and provides a first effect such as a tickler, a vibration effect, leg air, side air (L/R) or the like corresponding to the first effect control information if the first effect control information is received from the management server 300. At this point, if the slope of the first motion chair 100*a* is adjusted, the nozzle angle of the injector arranged on the backside of the first motion chair 100*a* is adjusted according to the slope of the backrest of the first motion chair to face the user positioned in the back row.

If the chair angle control information or the second effect control information is received from the management server 300, the second motion chair 100*b* placed in the front row of the first motion chair 100*a* adjusts the nozzle angle of the injector according to the chair angle control information and provides the user sitting in the first motion chair 100*a* with an effect such as an air shot, a water shot, a scent shot, a heater shot or the like corresponding to the second effect control information through the injector of the adjusted nozzle angle.

As described above, the motion chair 100 changes its position in three degrees of freedom, i.e., forward and backward, left and right, and upward and downward, and moves in the shape of the slope according to the chair angle control information or the effect control information and performs an internal operation such as thrusting, vibrating, tickling, air injecting, water injecting or the like using an apparatus embedded in the motion chair 100.

Such a motion chair 100 will be described in detail with reference to FIG. 3.

According to another embodiment of the present invention, an effect control system of a screening facility chair includes a first motion chair 100*a* occupied by a user, a second motion chair 100*b* placed in the front row of the first motion chair 100*a* and an input device 200. At this point, the first motion chair 100*a*, the second motion chair 100*b* and the input device 200 may be a form connected through a near field wireless communication such as ZigBee, Bluetooth or the like.

If chair angle control information or effect control information is input from a user, the input device 200 transmits the input chair angle control information or effect control information to a corresponding motion chair. That is, the input device 200 analyzes and classifies the effect control information into first effect control information or second effect control information and transmits the chair angle control information or the first effect control information to the first motion chair 100*a* corresponding to the input device 200 or transmits the chair angle control information or the second effect control information to the second motion chair 100*b* placed in the front row of the first motion chair 100*a*.

Since operation of the first motion chair 100*a* receiving the first effect control information and the second motion chair 100*b* receiving the second effect control information is the same as the operation of the first motion chair and the second motion chair shown in FIG. 2, description thereof will be omitted.

Figure 3:
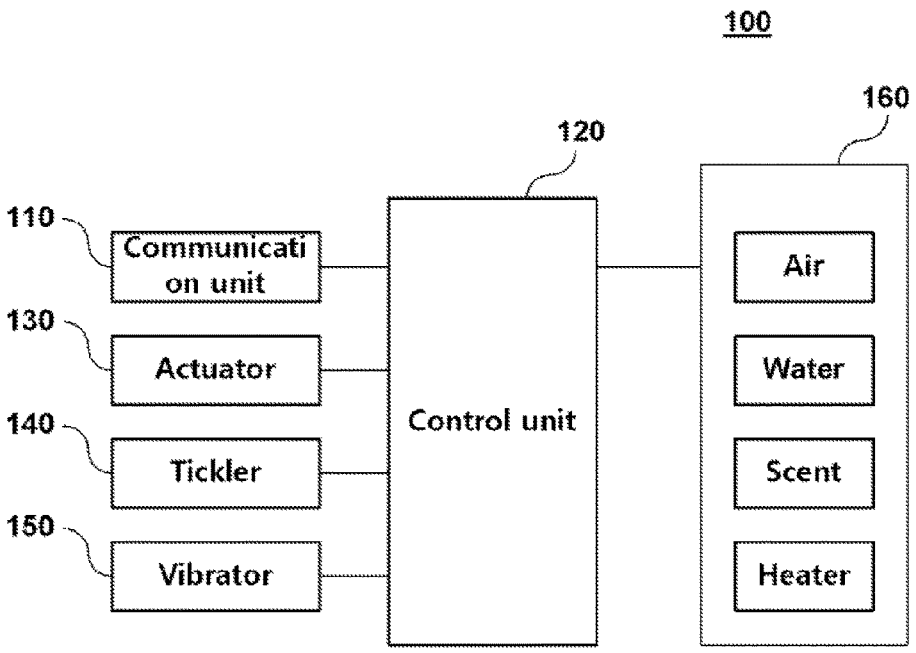
FIG. 3 is a block diagram showing the function of a motion chair according to an embodiment of the present invention.
Figure 4:
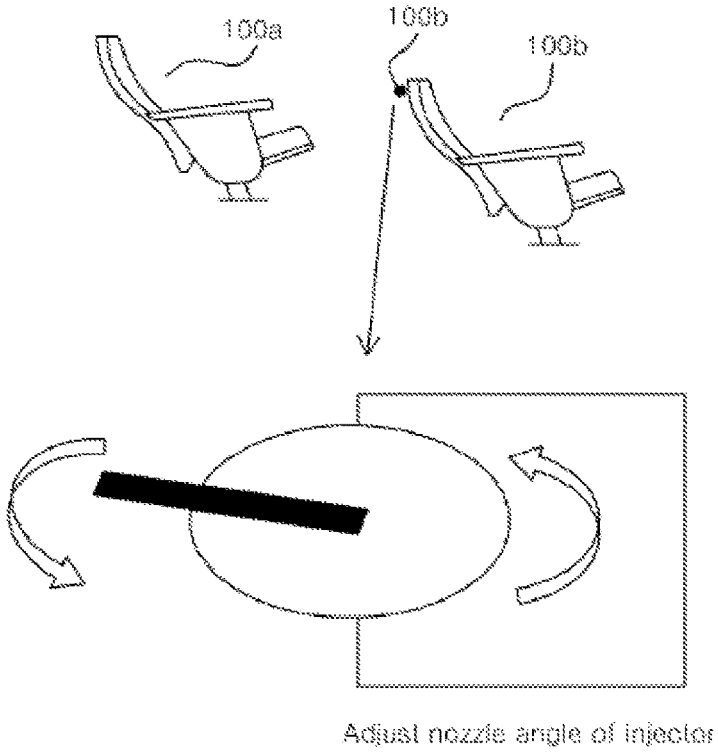
FIG. 4 is a view illustrating operation of an injector according to an embodiment of the present invention.
Figure 5:
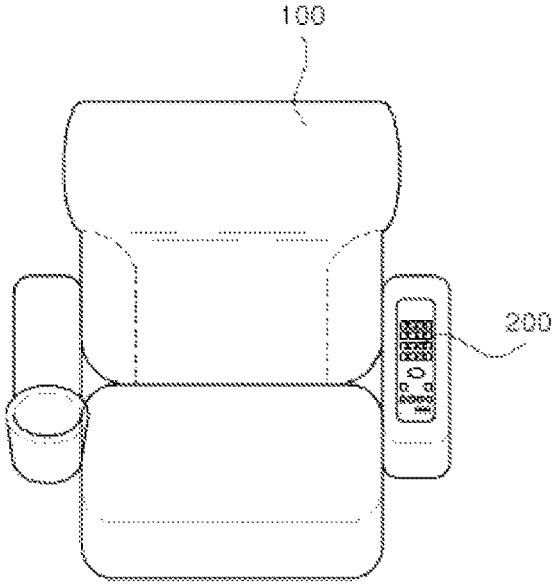
FIG. 5 is a view showing an input device installed in the armrest of a motion chair according to an embodiment of the present invention.
Figure 6:
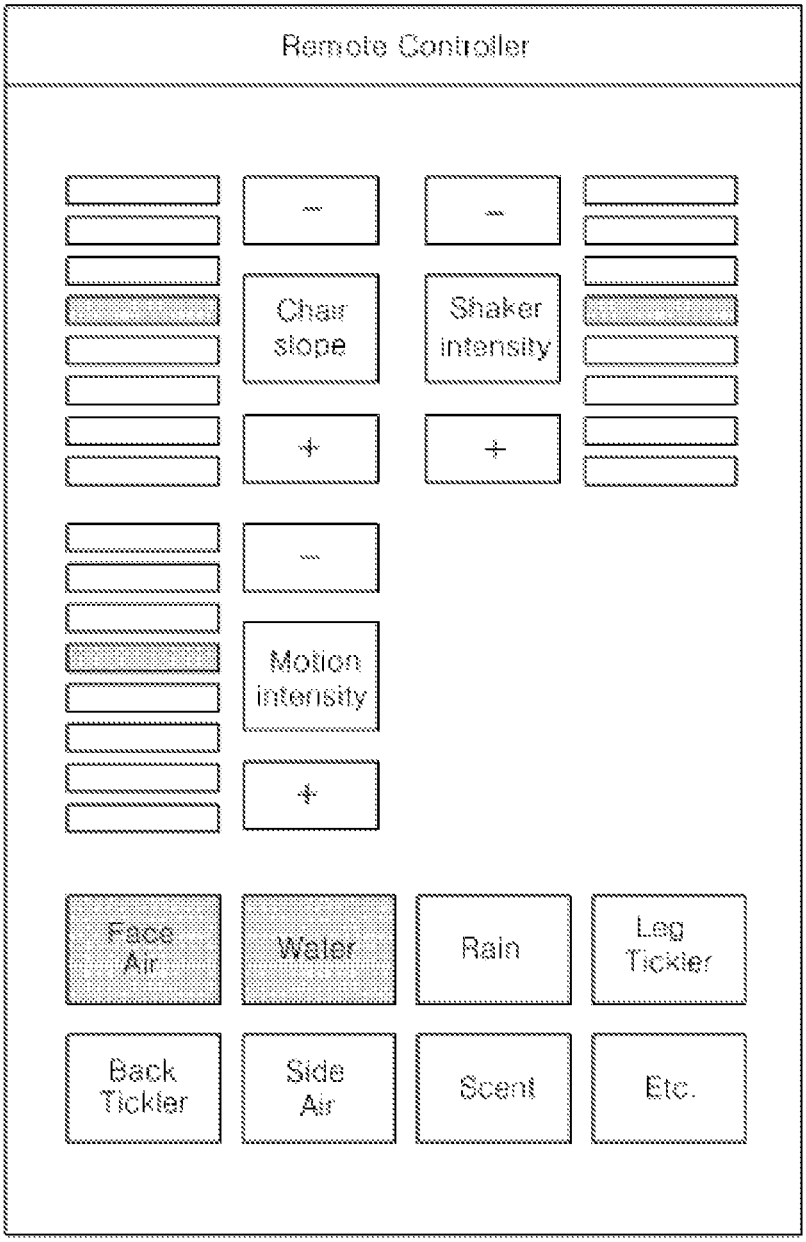
FIG. 6 is an exemplary view showing the screen of an input device according to an embodiment of the present invention.

FIG. 3 is a block diagram showing the function of a motion chair according to an embodiment of the present invention, FIG. 4 is a view illustrating operation of an injector according to an embodiment of the present invention, FIG. 5 is a view showing an input device installed in the armrest of a motion chair according to an embodiment of the present invention, and FIG. 6 is an exemplary view showing the screen of an input device according to an embodiment of the present invention.

Referring to FIG. 3, the motion chair 100 includes a communication unit 110, a control unit 120, an actuator 130, a tickler 140, a vibrator 150 and an injector 160.

The communication unit 110 performs communication with the management server or the motion chair through a communication network. Here, the communication network includes a wired communication network, a wireless communication network, a near field wired or wireless communication network and the like and is not limited to a specific communication network.

The control unit 120 receives chair angle control information or effect control information from the input device or the management server and controls a corresponding device according to the chair angle control information or the effect control information.

That is, the control unit 120 receives at least one of the chair angle control information, the first effect control information and the second effect control information from the input device or the management server, controls at least one of the actuator, the tickler and the vibrator according to the first effect control information, and controls the injector according to the second effect control information. Here, the first effect control information may be information input by a user sitting in a corresponding motion chair, and the second effect control information may be information input by a user sitting in a motion chair placed in the back row of a corresponding motion chair.

The actuator 130 adjusts the slope of the motion chair according to the chair angle control information transmitted from the input device or the management server. In addition, the actuator 130 performs a pitch motion, a roll motion, a heave motion, a square motion or the like under the control of the control unit 120.

The actuator 130 operates under the control of the control unit, and the pitch motion A, the roll motion B, the heave motion C, the square motion D and the like operate in combination according thereto. A viewer may receive an effect of moving back and forth when the motion chair 100 performs the pitch motion A, an effect of moving left and right when the motion chair 100 performs the roll motion B, and an effect of moving upwards and downwards when the motion chair 100 performs the heave motion C.

The tickler 140 performs a thrust function under the control of the control unit 120. A tickler 140 which can bring an effect of thrusting a viewer sitting in a motion chair may be embedded in the cushion of each chair. In addition, a tickler 140 which performs a thrust function according to an On/Off or time signal using a reciprocating solenoid may be embedded in the backrest part of a motion chair. In addition, a motion base is formed under the seat part of the motion chair to drive the motion chair in three degrees of freedom, and a leg support is formed under of the motion base so that a tickler 140 using a pneumatic cylinder may be embedded therein to perform a leg tickling function.

The vibrator 150 performs a vibration function under the control of the control unit 120. The vibrator 150 is used to show a vibration effect in the seat part of the motion chair by an input signal such as a sound source, a frequency or the like.

The tickler 140 and the vibrator 150 may be arbitrarily embedded and used in the backrest part or the seat part of the motion chair or the leg support.

The actuator 130, the tickler 140 and the vibrator 150 operate according to the first effect information input by the user sitting in a corresponding motion chair and provide a first effect to the user.

The injector 160 is positioned on the backside of the motion chair 100, adjusts the nozzle angle under the control of the control unit 120, and injects an air shot, a water shot, a scent shot, a heater shot or the like.

That is, the injector 160 is installed on the backside of the second motion chair placed in the front row of the first motion chair. A water shot for injecting water toward the person in the back row according to a given On/Off or time signal, an air shot for injecting air toward the person in the back row according to a given On/Off or time signal, a scent shot for injecting a scent toward the person in the back row according to a given On/Off or time signal, and a heater shot for injecting heat toward the person in the back row according to a given On/Off or time signal are formed in the injector 160.

The injector 160 is preferably positioned on the backside of the motion chair 100, and, in this case, the injector 160 of the second motion chair placed in the front row of the first motion chair occupied by a viewer injects an air shot, a water shot, a scent shot, a heater shot or the like to the viewer. The air shot, the water shot, the scent shot and the heater shot are controlled by the control unit 120.

As described above, since it is structured such that the second effects such as an air shot, a water shot, a scent shot, a heater shot and the like are not generated by a corresponding motion chair, but generated from the backside of the motion chair in the immediate front row and felt by a viewer sitting in the back row, the injector 160 of the motion chair placed in the front row according to seat arrangement is recognized correctly, and the 4D effects are controlled according to the second effect control information set by the viewer in the back row.

Accordingly, the motion chair 100 adjusts the nozzle angle of the injector 160*b* of the second motion chair in the front row according to adjustment of the slope of the first motion chair 100*a* in the back row as shown in FIG. 4. The bigger the slope of the first motion chair 100*a*, the nozzle angle of the injector 160*b* of the second motion chair is adjusted to face upwards. It should be done so to have the viewer sitting in the first motion chair 100*a* feel the effects of air, water and the like further more around the face.

In addition, if the slope of the backrest of the second motion chair 100*b*, in which the nozzle angle of the injector is adjusted according to the slope of the first motion chair 100*a*, is adjusted, the second motion chair 100*b* adjusts the nozzle angle of the injector again according to the adjusted slope of the backrest of the second motion chair 100*b* so that the viewer sitting in the first motion chair 100*a* may feel the second effect further more around the face.

Meanwhile, the motion chair 100 may be provided with an input device (not shown) at a specific position (e.g., in the armrest as shown in FIG. 5).

If a panel having a remote controller function is installed in the armrest of the motion chair 100 as an input device 200, the viewer sitting in the motion chair 100 may set intensity of a motion, an angle of the chair, effect control information and the like preferred by himself or herself using the input device 200. If the input device 200 is provided in the armrest of the motion chair 100, a personally customized service can be provided, and thus a viewer may enjoy a movie further comfortably when the viewer watches the movie in a 4DX theater.

Meanwhile, a chair slope button for adjusting the slope of the motion chair 100, a motion intensity button for adjusting intensity of a motion, and a shake intensity button for adjusting intensity of a shake are displayed in the input device 200 as shown in FIG. 6. A user may adjust the slope of a motion chair using the + and − direction buttons of the chair slope button. That is, the user may flatten or erect the motion chair forward and backward using the + and − direction buttons. The user may adjust intensity of a motion using the + and − direction buttons of the motion intensity button. For example, the user may adjust the motion intensity between 1 and 10, and the motion intensity may be automatically reset to intermediate when the movie is played. In addition, the user may adjust intensity of a shake using the + and − direction buttons of the shake intensity button. For example, the user may adjust intensity of shake back and shake bottom using the shake intensity button.

In addition, a face air button, a water button, a rain button, a leg tickler button, a back tickler button, a side air button, a scent button and the like are displayed in the input device. A user may set on or off of a face air effect by selecting the face air button, set on or off of a water effect by selecting the water button, set on or off of a rain effect by selecting the rain button, set on or off of a leg tickler effect by selecting the leg tickler button, set on or off of a back tickler effect by selecting the back tickler button, set on or off of a side air effect by selecting the side air button, and set on or off of a scent effect by selecting the scent button.

If the user inputs chair angle control information or effect control information using the buttons displayed in the input device, the input device transmits the input chair angle control information or effect control information to the management server or the control unit 120 through the communication unit 110.

If on/off of various digital signals such as air, water, scent, tickler and the like generated from the motion chair 110 is set and intensity of a motion is also set to a value desired by the user as described above, the input device transmits such effect control information to the management server through the communication unit 110.

Figure 7:
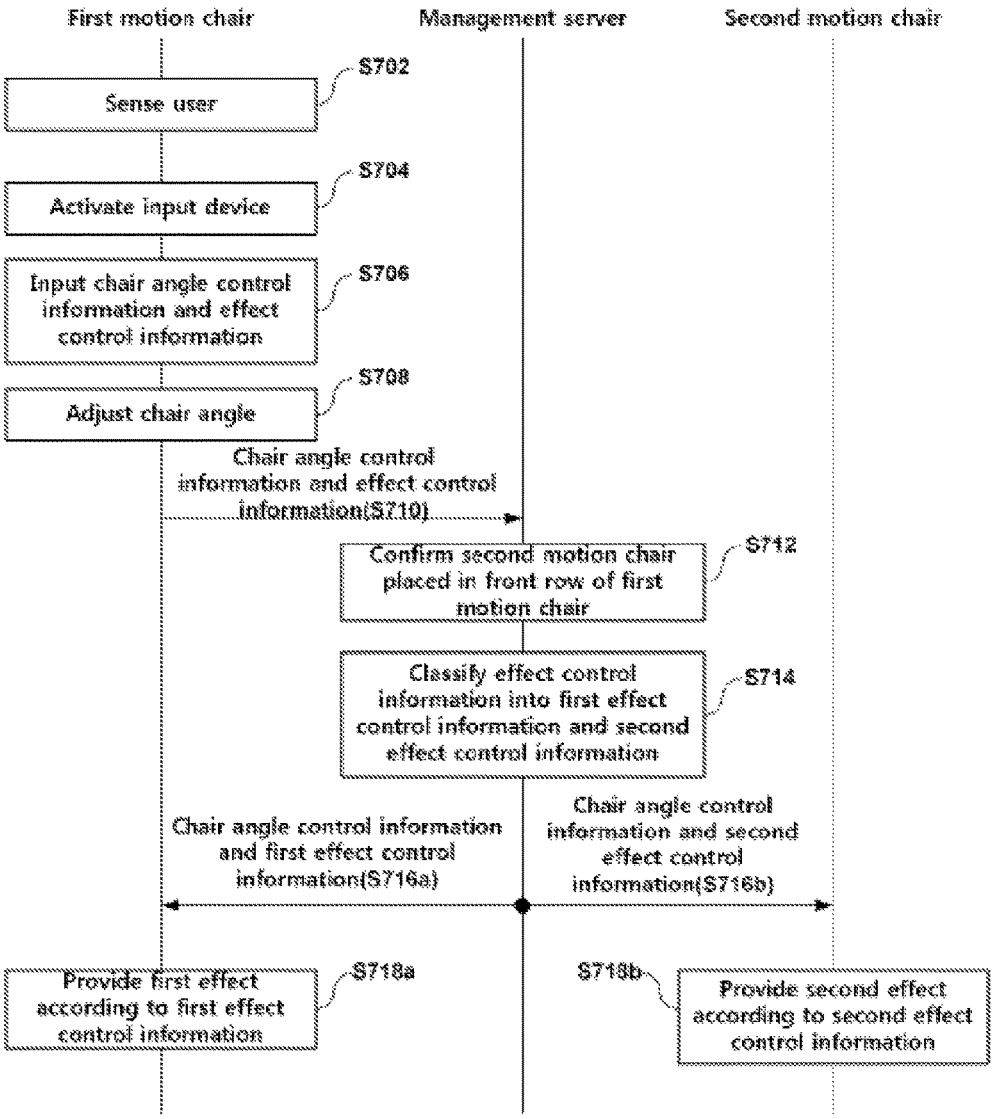
FIG. 7 is a view showing a method of controlling 4D effects in a first motion chair installed with an input device according to an embodiment of the present invention.

FIG. 7 is a view showing a method of controlling 4D effects in a first motion chair installed with an input device according to an embodiment of the present invention.

Referring to FIG. 7, if a user sits in a first motion chair, the first motion chair senses the user (step S702) and activates a provided input device (step S704). That is, the first motion chair senses sitting of the user using a human body sensor (e.g., a load cell or the like).

If the user inputs chair angle control information or effect control information using the activated input device (step S706), the first motion chair adjusts the slope according to the input chair angle control information (step S708) and transmits the chair angle control information or the effect control information to the management server (step S710). At this point, if the slope of the backrest of the first motion chair is adjusted, the position of the injector arranged on the backside of the first motion chair is changed according to the slope of the first motion chair, and thus in order to provide the user sitting in the back row of the first motion chair with a second effect such as an air shot, a water shot, a scent shot, a heater shot or the like, the nozzle angle of the injector arranged on the backside of the first motion chair should be adjusted according to the slope of the backrest of the first motion chair.

The management server confirms a second motion chair placed in the front row of the first motion chair (step S712) and classifies the effect control information into first effect control information and second effect control information (step S714).

Then, the management server transmits the chair angle control information or the first effect control information to the first motion chair (step S716*a*) and transmits the chair angle control information or the second effect control information to the second motion chair (step S716*b*).

Then, the first motion chair provides a first effect corresponding to the first effect control information (step S718*a*), and the second motion chair adjusts the nozzle angle of the injector according to the chair angle control information of the first motion chair and provides a second effect corresponding to the second effect control information through the injector of the adjusted nozzle angle (step S718*b*). Here, the first effect provided by the first motion chair may include a tickler, a vibration effect, leg air, side air (L/R) and the like, and the second effect provided by the second motion chair may include an air shot, a water shot, a scent shot, a heater shot and the like.

Figure 8:
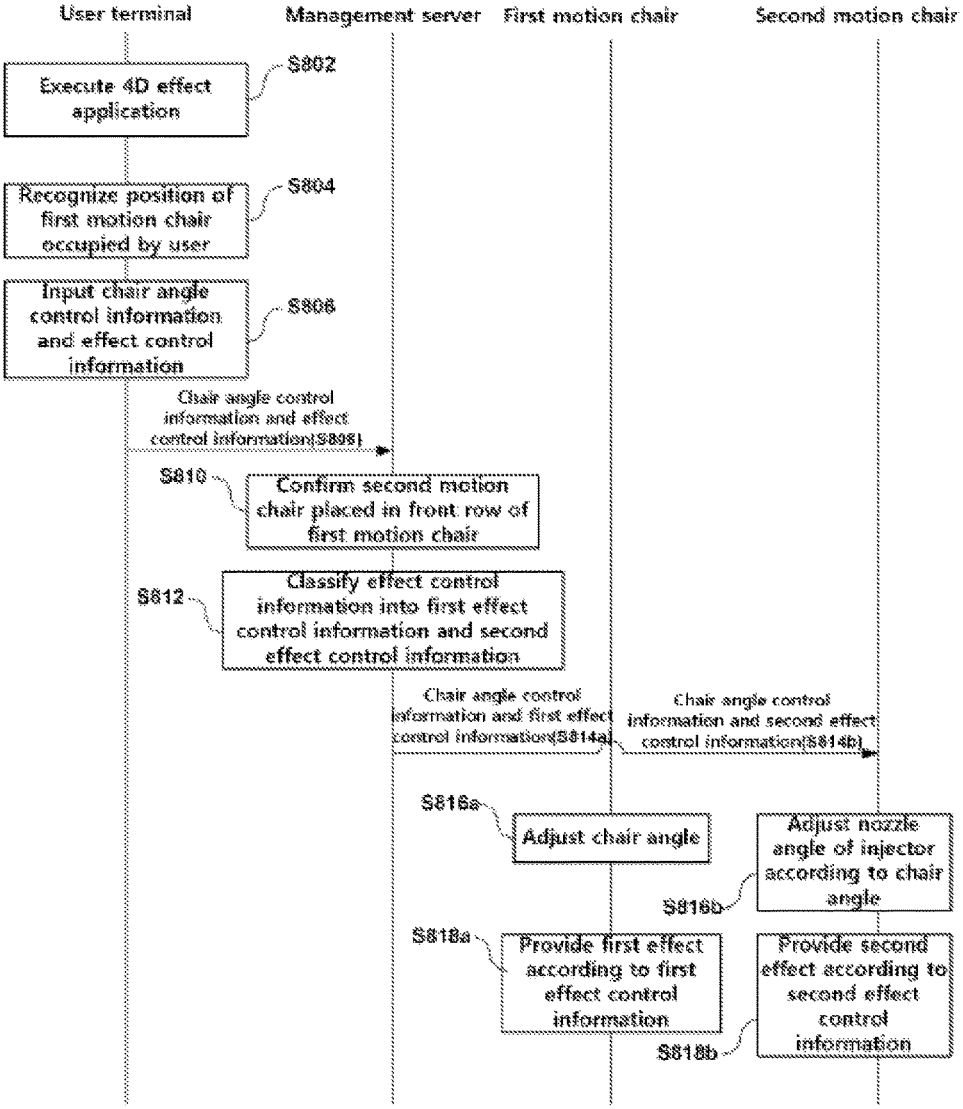
FIG. 8 is a view showing a method of controlling 4D effects in a first motion chair when a user terminal functions as an input device according to another embodiment of the present invention.

FIG. 8 is a view showing a method of controlling 4D effects in a first motion chair when a user terminal functions as an input device according to another embodiment of the present invention.

Referring to FIG. 8, if a user executes a 4D effect application installed in a user terminal (step S802), the user terminal recognizes that the chair occupied by the user is a first motion chair (step S804). At this point, the user terminal recognizes the first motion chair by tagging a code such as a bar code, a QR code or the like installed in the first motion chair or by using a position recognition unit (e.g., a GPS or the like) embedded in the user terminal.

Then, if the user inputs chair angle control information or effect control information through the 4D effect application (step S806), the user terminal transmits the chair angle control information or the effect control information to the management server (step S808). At this point, the user terminal also transmits information on the first motion chair recognized in step S804.

The management server confirms a second motion chair placed in the front row of the first motion chair (step S810) and classifies the effect control information into first effect control information and second effect control information (step S812).

Then, the management server transmits the chair angle control information or the first effect control information to the first motion chair (step S814*a*) and transmits the chair angle control information or the second effect control information to the second motion chair (step S814*b*).

Then, the first motion chair adjusts the slope according to the chair angle control information (step S816*a*), and the second motion chair adjusts the nozzle angle of the injector according to the slope of the first motion chair (step S816*b*). At this point, if the slope of the backrest of the first motion chair is adjusted, the position of the injector arranged on the backside of the first motion chair is changed according to the slope of the first motion chair, and thus in order to provide the user sitting in the back row of the first motion chair with a second effect such as an air shot, a water shot, a scent shot, a heater shot or the like, the nozzle angle of the injector arranged on the backside of the first motion chair should be adjusted according to the slope of the backrest of the first motion chair.

Then, the first motion chair provides a first effect corresponding to the first effect control information (step S818*a*) and provides a second effect corresponding to the second effect control information through the injector of the adjusted nozzle angle (step S818*b*).

Figure 9:
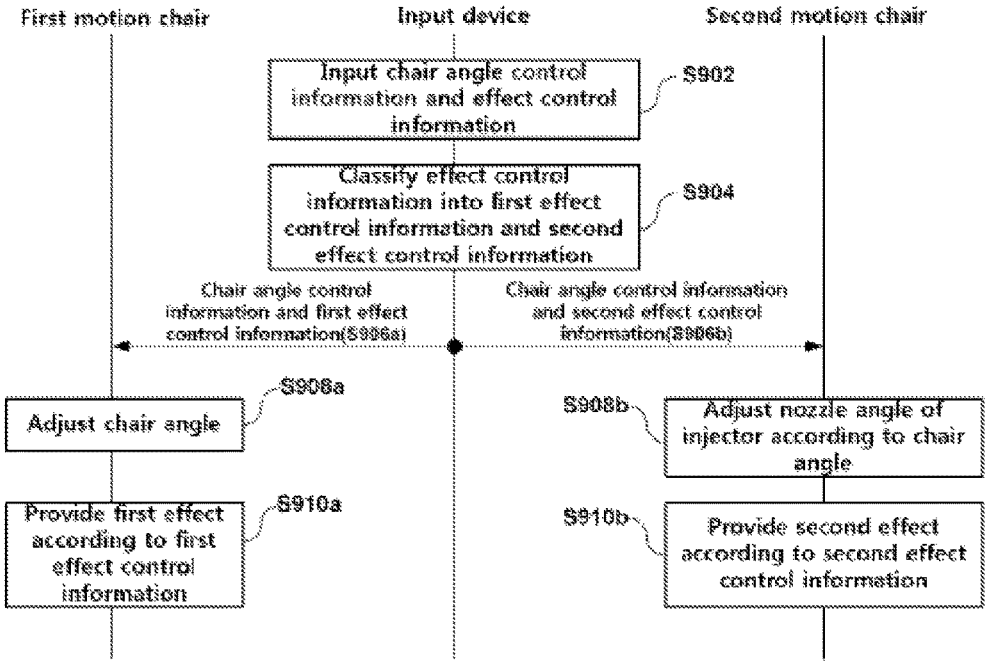
FIG. 9 is a view showing an effect control method of a screening facility chair according to still another embodiment of the present invention.

FIG. 9 is a view showing an effect control method of a screening facility chair according to still another embodiment of the present invention.

Referring to FIG. 9, if a user sitting in the first motion chair inputs chair angle control information or effect control information using an input device (step S902), the input device classifies the effect control information into the first effect control information provided to the first motion chair and the second effect control information provided to the second motion chair (step S904).

Then, the input device transmits the chair angle control information or the first effect control information to the first motion chair (step S906*a*) and transmits the chair angle control information or the second effect control information to the second motion chair (step S906*b*).

Then, the first motion chair adjusts the slope according to the chair angle control information (step S908*a*) and provides a first effect corresponding to the first effect control information (step S910*a*). At this point, if the slope of the backrest of the first motion chair is adjusted, the position of the injector arranged on the backside of the first motion chair is changed according to the slope of the first motion chair, and thus in order to provide the user sitting in the back row of the first motion chair with a second effect such as an air shot, a water shot, a scent shot, a heater shot or the like, the nozzle angle of the injector arranged on the backside of the first motion chair should be adjusted according to the slope of the backrest of the first motion chair.

The second motion chair adjusts the nozzle angle of the injector according to the slope of the first motion chair (step S908*b*) and provides a second effect corresponding to the second effect control information through the injector of the adjusted nozzle angle (step S910*b*).

Meanwhile, the effect control method of a screening facility chair of the present invention described above may be implemented in the form of a program, an application or a system file for performing the method, and the present invention may be implemented in the form of a computer-readable recording medium recording such a program or the like.

Those skilled in the art may understand that the present invention can be embodied in other specific forms without departing from technical spirits and essential characteristics of the present invention. Therefore, the embodiments described above are illustrative and not restrictive in all respects. The scope of the present invention should be determined by the appended claims rather than the detailed description, and the meaning and scope of the claims and all changed and modified forms derived from the equivalent concepts thereof should be interpreted to be included in the scope of the present invention.

The invention claimed is:

1. An effect control system of a screening facility chair, the system comprising:

an input device for transmitting chair angle control information or effect control information input from a user to a management server;

the management server for transmitting the chair angle control information or the effect control information to a corresponding motion chair;

a first motion chair for adjusting a slope according to the chair angle control information and providing an effect synchronized with an image according to the effect control information, and a second motion chair placed in a front row of the first motion chair, wherein a nozzle angle of an injector arranged on a backside of each of the first motion chair and the second motion chair is adjusted according to slope of the first motion chair or the second motion chair.

2. The system according to claim 1, wherein the management server analyzes and classifies the effect control information into first effect control information and second effect control information, and transmits the chair angle control information or the first effect control information to the first motion chair corresponding to the input device or transmits the chair angle control information or the second effect control information to the second motion chair.

3. The system according to claim 2, wherein the first motion chair adjusts the slope according to the chair angle control information or provides a first effect synchronized with the image according to the first effect control information.

4. The system according to claim 3, wherein if the slope is adjusted, the first motion chair adjusts a nozzle angle of the injector arranged on a backside of the first motion chair according to the slope of the first motion chair.

5. The system according to claim 2, wherein the second motion chair adjusts a nozzle angle of the injector according to the slope of the first motion chair and provides a user sitting in the first motion chair with a second effect synchronized with the image according to the second effect control information through the injector of the adjusted nozzle angle.

6. The system according to claim 2, wherein the first effect control information includes at least one of a tickler, a vibration effect, leg air and side air (L/R), and the second effect control information includes at least one of an air shot, a water shot, a scent shot and a heater shot.

7. The system according to claim 1, wherein the input device is any one of an input device installed in a specific area of the motion chair, a separate near field communication terminal and a user terminal.

8. An effect control system of a screening facility chair, the system comprising:

an input device for transmitting chair angle control information or effect control information input from a user to a corresponding motion chair;

a first motion chair for adjusting a slope according to the chair angle control information and providing an effect synchronized with an image according to the effect control information, and a second motion chair placed in a front row of the first motion chair, wherein a nozzle of an injector arranged on a backside of the first motion chair or the second motion chair is adjusted according to slope of the first motion chair or the second motion chair.

9. The system according to claim 8, wherein the input device and the motion chair are connected through near field communication.

10. The system according to claim 8, wherein the input device analyzes and classifies the effect control information into first effect control information and second effect control information, and transmits the chair angle control information or the first effect control information to the first motion chair corresponding to the input device or transmits the chair angle control information or the second effect control information to the second motion chair.

11. The system according to claim 10, wherein the first motion chair adjusts the slope according to the chair angle control information or provides a first effect synchronized with the image according to the first effect control information.

12. The system according to claim 11, wherein if the slope is adjusted, the first motion chair adjusts a nozzle angle of the injector arranged on a backside of the first motion chair according to the slope of the first motion chair.

13. The system according to claim 10, wherein the second motion chair adjusts a nozzle angle of the injector according to the slope of the first motion chair and provides a user sitting in the first motion chair with a second effect synchronized with the image according to the second effect control information through the injector of the adjusted nozzle angle.

14. The system according to claim 10, wherein the first effect control information includes at least one of a tickler, a vibration effect, leg air and side air (L/R), and the second effect control information includes at least one of an air shot, a water shot, a scent shot and a heater shot.

15. The system according to claim 8, wherein the input device is any one of an input device installed in a specific area of the motion chair, a separate near field communication terminal and a user terminal.

16. An effect control method of a screening facility chair, the method comprising the steps of:

transmitting chair angle control information or effect control information input from a user to a corresponding motion chair, by an input device; and adjusting a slope according to the chair angle control information and providing an effect synchronized with an image according to the effect control information, by a motion chair, wherein a second motion chair is placed in a front row of the first motion chair, and wherein a nozzle of an injector arranged on backside of the first motion chair or the second motion chair is adjusted according to slope of the first motion chair or the second motion chair.

17. The method according to claim 16, wherein the step of transmitting chair angle control information or effect control information input from a user to a corresponding motion chair by an input device includes the steps of:

receiving the chair angle control information or the effect control information from the user;

analyzing and classifying the effect control information into first effect control information and second effect control information; and transmitting the chair angle control information or the first effect control information to the first motion chair corresponding to the input device or transmitting the chair angle control information or the second effect control information to the second motion chair.

18. The method according to claim 16, wherein the step of adjusting a slope according to the chair angle control information or providing an effect synchronized with an image according to the effect control information by the first motion chair includes the step of adjusting, when the chair angle control information or first effect control information is received from the input device, the slope according to the chair angle control information or providing a first effect synchronized with the image according to the first effect control information, and adjusting, when the chair angle control information or second effect control information is received from the input device, a nozzle angle of the injector according to the chair angle control information and providing a second effect synchronized with the image according to the second effect control information through the injector of the adjusted nozzle angle.

* * * * *